United States Patent [19]

Jantzen

[11] 4,286,524

[45] Sep. 1, 1981

[54] PRESSURIZED HOPPER CAR INTERIOR SIDE AND ROOF BRACING SUPPORT STRUCTURE

[75] Inventor: Steve L. Jantzen, St. Louis, Mo.

[73] Assignee: ACF Industries, Inc., New York, N.Y.

[21] Appl. No.: 71,968

[22] Filed: Sep. 4, 1979

[51] Int. Cl.[3] ..... B61D 7/04; B61D 17/08; B61D 17/12; B61D 49/00

[52] U.S. Cl. ..... 105/248; 105/377; 105/406 R; 105/411; 406/119

[58] Field of Search ..... 105/247, 248, 358, 360, 105/377, 406 R, 411; 406/119, 122, 175

[56] References Cited

U.S. PATENT DOCUMENTS

| | | | |
|---|---|---|---|
| 1,810,770 | 6/1931 | Kind | 105/248 |
| 3,269,779 | 8/1966 | Rollins | 406/119 |
| 3,339,499 | 9/1967 | Charles | 106/360 X |
| 3,713,399 | 1/1977 | Bembridge et al. | 105/248 X |
| 3,995,541 | 12/1976 | Coyle et al. | 105/248 X |
| 4,016,691 | 4/1977 | Cale | 105/24 B X |

*Primary Examiner*—Joseph F. Peters, Jr.
*Assistant Examiner*—Howard Beltran
*Attorney, Agent, or Firm*—Henry W. Cummings

[57] ABSTRACT

In a pressurized railway hopper car vertical and horizontal reinforcement members are strategically located relative to the car side plate to counteract the moment M caused by the internal pressure applied to the side sheets and to the roof. The vertical reinforcement member is spaced inwardly from the shear center of the side plate a distance determined by dividing the value of the moment M by the vertical component of the membrane pressure loads applied to the roof and to the side sheet. Horizontally extending reinforcements are provided extending between the laterally spaced side plates which are attached to the side plates at approximately the shear center of the side plate. With the horizontal and vertical members thus located, the vertical and horizontal reinforcing members will carry substantially axial loads only, essentially eliminating bending, and thus may be of reduced size as compared to the size which would be required if these members also carried bending loads.

13 Claims, 6 Drawing Figures

PRESSURIZED HOPPER CAR INTERIOR SIDE AND ROOF BRACING SUPPORT STRUCTURE

BACKGROUND OF THE INVENTION

This invention relates to covered railway hopper cars designed to withstand internal pressure.

In U.S. Pat. No. 3,269,779 a stub sill railway hopper car designed to withstand up to 15 psi includes an arcuate top portion struck from a constant radius. Longitudinally extending upper chords are located at the juncture of the top portion with side sheets extending inwardly and downwardly from the upper chords on opposite sides of the car. Longitudinally extending side sills are located on the lower portion of the side sheets on each side of the car. Boxed channel reinforcing members are located adjacent vertical bulkheads inside the car which extend throughout the arcuate top portion and down the side sheets. Transverse reinforcements also extend between the longitudinal upper chords above each hopper outlet. Formation of the arcuate roof is difficult and expensive. Furthermore the box channel reinforcements add considerable weight to the car.

In U.S. Pat. No. 3,339,499 a stub sill covered hopper car is disclosed in which a curved roof extends between top chords located on opposite sides of the car. Curved side sheets extend downwardly to side sills extending longitudinally of the car. In adapting this car to withstand moderate internal pressure of around 5 psi, the top chords are reinforced by a rib stiffener extending one-two (1-2) feet down the side sheet and welded to the side sheet. See for example, ACF Shippers Car Line Brochure No. SCL-CF42 December 1969, copy in application file.

When pressure is applied to the interior of a covered hopper car such as that illustrated in U.S. Pat. No. 3,339,499, the top chord as shown in FIGS. 1 and 2, is loaded in the following manner. The membrane force $Pr_2$, internal pressure acting in a direction perpendicular to the roof times the radius of curvature in roof sheet 10, loads roof 10 with a uniform continuous load. The membrane force $Pr_1$, acting in a direction perpendicular to the side sheet 14, loads side sheet 14 with a uniform continuous load. The eccentricity of loads $Pr_2$ and $Pr_1$ with respect to the centroid of the top cord causes a moment M in the Z direction (FIG. 2).

SUMMARY OF THE INVENTION

In accordance with the present invention, vertical and horizontal reinforcement members are strategically located to cause a moment to counteract the moment M caused by $Pr_1$ and $Pr_2$. The vertical reinforcement members are located in each hopper and are spaced inwardly from the shear center of the side plate a distance determined by dividing the value of the moment M by the vertical component of the membrane pressure loads applied to the roof and to the side sheet. Horizontally extending reinforcements are also provided extending between the laterally spaced side plates in each hopper which are attached to the side plates at approximately the shear center of the side plate. With the horizontal and vertical members thus located, these reinforcing members will carry essentially axial loads only, essentially eliminating bending, and thus may be of reduced size as compared to the size which would be required if these members also carried bending loads.

THE DRAWINGS

DESCRIPTION OF PREFERRED EMBODIMENTS

Figure 3:
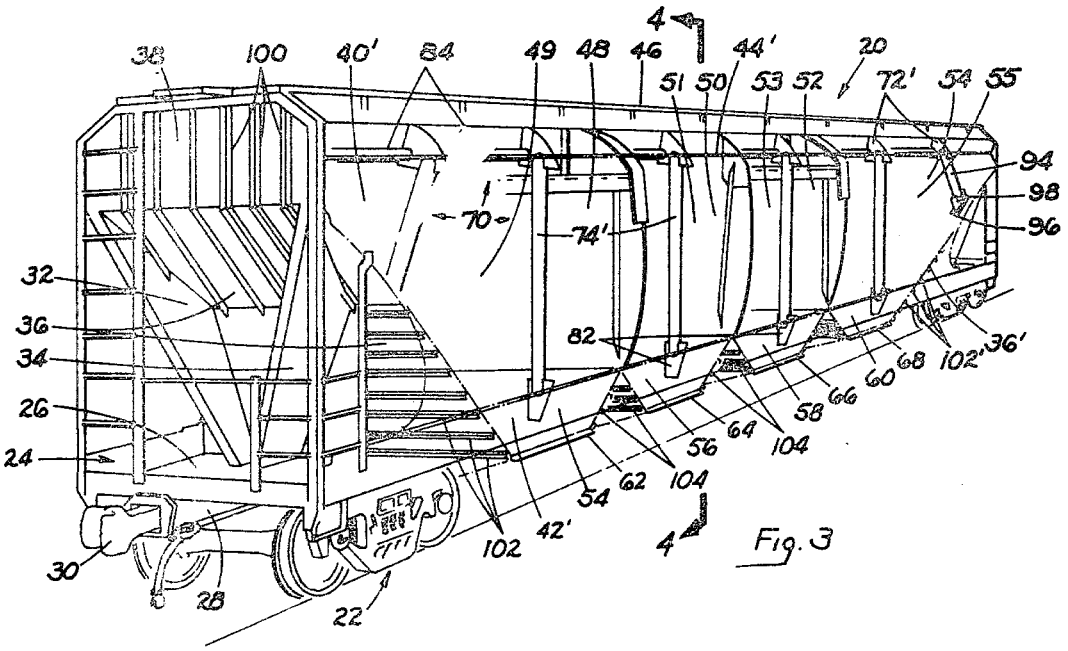
FIG. 3 is a schematic prospective view of a railway hopper car illustrating the reinforcements of the present invention.

A railway hopper car 20 is constructed generally according to the teachings of U.S. Pat. No. 3,339,499, hereby incorporated into the present application by this reference. Briefly, trucks 22 located at opposite ends of the car support end structures 24 including a shear plate 26. A stub sill 28 has housed therein a conventional coupler 30 and a draft gear (not shown). End diagonals 32 and 34 extend downwardly from end slope sheets 36, 36' having a vertical upper portion 38.

Figure 4:
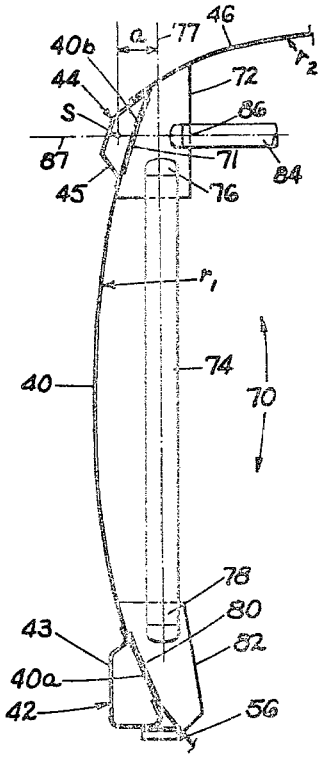
FIG. 4 is an enlarged vertical section illustrating the reinforcements of the present invention.

Side sheets 40 extend vertically between longitudinally extending side sills 42, 42' and side plates or top chords 44 (FIG. 4). Side sill 42 includes an outer formed plate 43 welded to an extension **40*a* of side sheets 40, 40'. Side plate 44 includes an outer plate 45 welded to an extension 40*b* of side sheet 40. A roof 46 extends between side plates 44, and is welded to outer plate 45**.

Figure 2:
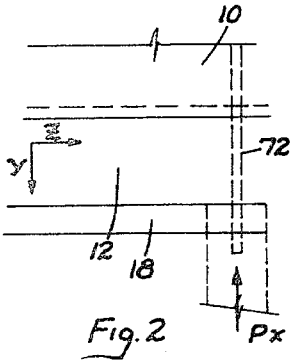
FIG. 2 is a view looking in the direction of the arrows along line 2—2 in FIG. 1.

Transverse bulkheads 48, 50 and 52 (FIG. 2) divide the car into separate hoppers, 49, 51, 53, and 55, each having downwardly extending slope sheets 54, 56, 58, and 60, and outlets 62, 64, 66 and 68.

In accordance with the present invention, a pressure reinforcing structure 70 is provided in the car. This pressure reinforcing structure is located in each hopper and includes a plate 71 welded to top plate 44 along side sheet extension **40*b*. A gusset 72 appropriately shaped is welded to plate 71, roof 46 and side sheet 40**.

Figure 1:
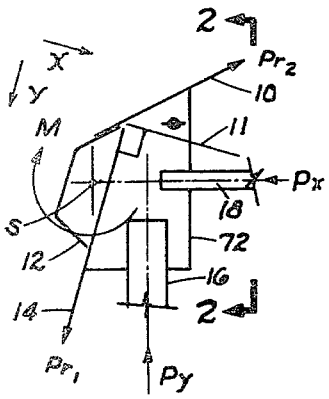
FIG. 1 is a schematic vertical section view illustrating the loads applied to the side sheet, side plate, and roof in a railway hopper car due to internal pressure.

A vertical column 74 preferably of tubular shape is provided with a slot 76 into which extends gusset 72. The center line 77 of column 74 is spaced from the shear center approximately a distance "a" determined by dividing the value of the moment M (FIG. 1) by the vertical component of the membrane pressure loads (Py) applied by the roof $Pr_1$ and by the side sheet $Pr_2$.

Column 74 also includes a slot 78 at its lower end. A longitudinal plate 80 is welded to side sheet extension **40*a*. A gusset 82 is welded to side sheet 40, plate 80 and also to slope sheet 56, and to slope sheets 54, 58, and 60 in the outer hoppers. Column 74 is welded to gusset 82 around slot 78 along center line 77. Column 74** is conveniently a pipe section six (6) inches in diameter having a thickness of 0.28 inches.

A horizontal column 84 also includes a slot 86 and is welded on opposite sides of the car to gusset 72. The center line 87 of column 84 is located substantially at the shear center of side plate 44. With the horizontal and vertical members thus located, these reinforcing members will carry essentially axial loads only, essentially eliminating bending, and thus may be of reduced size as compared to the size which would be required if these members also carried bending loads.

On the opposite side of the car a similar vertical column 74' (FIG. 2) is welded to respective gussets 72' and 82'. The vertical columns 74, 74' and the transverse columns 84 are located generally at the center of each of the hoppers 49, 51, 53, and 55.

Figure 5:
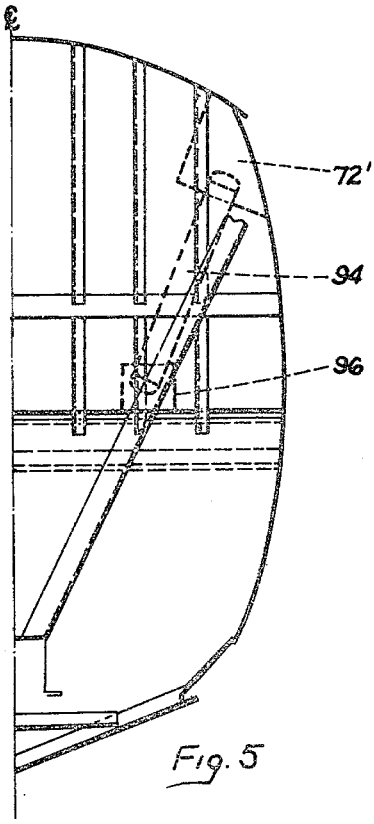
FIG. 5 is a partial end view illustrating end reinforcement.

In addition, in end hoppers 49 and 55 vertical columns 94 (FIGS. 3 and 5) on each side of the car extend diagonally downwardly and inwardly from gussets 72, 72' to end slope sheets 36, 36'. A plate 96 extending parallel to end slope sheets 36, 36' is welded to respective end slope sheets 36, 36'. A plate 98 extending perpendicular to plate 96 and respective end slope sheets 36, 36' is welded to plate 96. Columns 94 are preferably attached to gussets 72' a distance "a" from the shear center of side plate 44, 44', as described above.

As is the case of the car described in the brochure SCL-CF42, December 1969, a plurality of vertical end reinforcements 100 (FIG. 3) are provided on the external surface of end sheets 36 to withstand the membrane pressure applied to the end walls. In addition, transverse reinforcements 102, 102' are provided, welded to the external surface of end walls 36, 36'. Additional transverse reinforcements 104 are provided on slope sheets 54, 56, 58, and 60.

With the vertical columns 74, 74' located inwardly from the shear center of side plates 44, 44' essentially equal to the distance "a" as defined above, the vertical columns may be 6 (six) inch diameter pipe sections of steel to withstand a pressure of about 15 psi within the car. The distance "a" has been found to be six (6) to seven (7) inches for a fifty-five (55) foot railway hopper car having a height of fifteen (15) feet, a distance of nine (9) feet between side plates and a distance of nine (9) feet between the side plate and the sidesill. See Example I. If transverse reinforcements 84 are attached to gussets 72, 72' essentially at the shear center of side plates 44, 44', transverse reinforcements 84 may be two (2) inch pipe sections of steel and withstand an internal pressure of about 15 psi.

It is particularly to be noted that vertical columns 74, 74' are considerably shorter than the vertical reinforcements in U.S. Pat. No. 3,269,779.

EXAMPLE I

In FIG. 4, $r_1$ the radius of curvature of the side sheet is 170 inches and $r_2$ the radius of curvature of the roof is 90.9 inches. The angle $\theta$ between the roof sheet and the line of action 11 of the pressure P in the hopper applied to the cross sectional area of the side plate is 47.6 degrees. The non-membrane, flat area of the side plate subject to direct internal pressure is 19.25 in $2/_{in}$. The X direction is defined as perpendicular to the side plate and the Y direction as down the side sheet. The forces in the X and Y directions are:

$$W_x = 90.00 \text{ Cos } 47.61 - 19.25P = 42.03P \text{ pounds per inch}$$

$$W_y = 170P - 90.9P \text{ Sin } 17.61 = 102.9P \text{ pounds per inch,}$$

where P is the pressure in the hopper.

Assuming the pressure P in the hopper 22.5 psi at the top (including a safety factor above 15 psi) and 26.0 psi in the bottom, the average pressure is $$22.5 + 26/2 = 24.25$$

$$W_x = 42.3\ (24.25) = 1019 \text{ lb. per inch of side plate}$$

$$W_y = 102.9\ (24.25) = 2495 \text{ lb. per inch of side plate}$$

It is assumed that the shear center is located at the center of gravity. For this shape a computer analysis was used to determine the center of gravity and was found to be 1.89 inches inboard of the side sheet, and 4.83 inches from the line of action along the roof sheet.

The moments about the shear center are $$M_2 = 170(P)\ (1.89) + 4.83 \times 90.9P = 765 \text{ lb. per inch}$$

$$M_2 = 760(24.25) = 18430 \text{ in. lb./inch of side plate}$$

Figure 6:
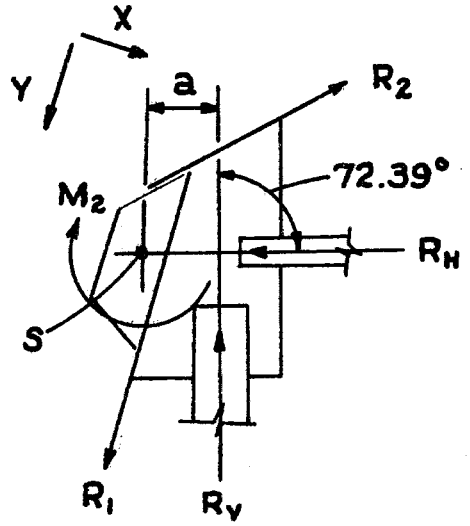
FIG. 6 is a diagram of the forces applied to a railway car side plate in accordance with the present invention.

These are loads per unit length of side plate, and they are reacted at a location in the center portion of the hopper at vertical reinforcements 74, 74', and a transverse reinforcement 84. These reactions are calculated in a known manner by computer program shown in FIG. 6.

where $R_1 = 179$ Kips; $R_2 = 73.14$ Kips and $M_2 = 1234$ in K. Resolving these reactions into vertical and horizontal loads acting on vertical and horizontal members $R_v = R_1 \text{ Sin } 72.39 + R_2 \text{ Cos } 72.39$ $R_v = 179 \text{ Sin } 72.39 + 73.14 \text{ Cos } 72.39 = 192.74$ $R_H = R_2 \text{ Sin } 72.39 - R_1 \text{ Cos } 72.39$ $R_H = 73.14 \text{ Sin } 72.39 - 179 \text{ Sin } 72.39 = 15.56$ $M_2 = 18.43\ K \text{ in.} \times 67 = 1234 \text{ in. } K$ To determine the distance a:

$a = (M_2/R_V) = 1234.8/192.74 = 6.41$ inches from the shear center.

What is claimed is:

1. A pressurized railway hopper car comprising: trucks supporting the car at opposite ends thereof; side sheets located on opposite sides of the car and extending vertically between transversely spaced side sills located at the lower portion of the side sheets and transversely spaced side plates located at the upper portion of the side sheets; a roof extending between said side plates; included sheets attached to the lower portion of the side sheets defining at least one hopper in the car; at least one vertical reinforcement located on each side of said hopper; upper connecting means extending between each of said vertical reinforcements and its respective sie plate to anchor said reinforcement at its upper portion; lower connecting means attaching said vertical reinforcement at its lower portion to its respective side sill; horizontally extending reinforcements extending between said upper connecting means at approximately the shear center of each side plate; said vertical reinforcements spaced inwardly from the shear center of its respective side plate a distance such that said vertical and said horizontal reinforcements carry substantially axial loads resulting from membrane pressure loads applied substantially uniformly upon said side sheets and upon said roof.

2. A pressurized hopper car according to claim 1 wherein said upper connecting means comprises an upper gusset extending between said side plate and said vertical reinforcement.

3. A pressurized hopper car according to claim 2 wherein said horizontal reinforcement is also connected to said upper gusset.

4. A pressurized hopper car according to claim 2 wherein a lower gusset extends between the lower portion of said vertical reinforcement and said side sill.

5. A pressurized hopper car according to claim 4 wherein said vertically extending reinforcement is a pipe section.

6. A pressurized hopper car according to claim 5 wherein said horizontally extending reinforcement is a pipe section.

7. A pressurized hopper car according to claim 6 wherein said pipe sections contain slits at their respective ends which facilitate welding said pipe sections to said gussets.

8. A pressurized hopper according to claim 4 wherein said upper gusset is welded to said side plate and said roof and said side sheet.

9. A pressurized hopper car according to claim 8 wherein said lower gusset is welded to said side sill, said side sheet and an inwardly inclined slope sheet.

10. A pressurized hopper car according to claim 9 wherein said upper gusset and said lower gusset include a reinforcing plate extending parallel respectively to said side plate.

11. A pressurized hopper car according to claim 1 wherein a plurality of hoppers are provided in said car and each hopper includes said vertically and horizontally extending reinforcements.

12. A pressurized hopper car according to claim 11 wherein said reinforcements are located generally at the mid-portion of said hoppers.

13. A pressurized hopper car according to claim 11 wherein a pair of vertically extending reinforcements are attached to the end slope sheets of each end hopper.

* * * * *